US011987905B2

(12) United States Patent
Enqvist et al.

(10) Patent No.: US 11,987,905 B2
(45) Date of Patent: May 21, 2024

(54) MONOFILAMENT YARN

(71) Applicant: Valmet Technologies, Inc., Espoo (FI)

(72) Inventors: Rauno Enqvist, Espoo (FI); Hannu Martikainen, Espoo (FI); Juha Paavolainen, Espoo (FI)

(73) Assignee: Valmet Technologies, Inc., Espoo (FI)

( * ) Notice: Subject to any disclaimer, the term of this patent is extended or adjusted under 35 U.S.C. 154(b) by 44 days.

(21) Appl. No.: 17/830,538

(22) Filed: Jun. 2, 2022

(65) Prior Publication Data

US 2022/0389618 A1 Dec. 8, 2022

(30) Foreign Application Priority Data

Jun. 4, 2021 (FI) ..... 20215654

(51) Int. Cl.
*D01D 5/253* (2006.01)
*D01F 6/76* (2006.01)
*D01F 6/94* (2006.01)

(52) U.S. Cl.
CPC ..... *D01D 5/253* (2013.01); *D01F 6/76* (2013.01); *D01F 6/94* (2013.01)

(58) Field of Classification Search
None
See application file for complete search history.

(56) References Cited

U.S. PATENT DOCUMENTS 6,037,047 A 3/2000 Fastenau et al.
6,773,786 B1 8/2004 Kuckart
2019/0040579 A1 2/2019 Enqvist et al.
2020/0080236 A1* 3/2020 Fischer ..... D01F 6/30
2021/0102339 A1 4/2021 Enqvist

FOREIGN PATENT DOCUMENTS

| | | | |
|---|---|---|---|
| CA | 2026750 | | 4/1991 |
| DE | 102005056472 | * | 5/2007 |
| EP | 0405034 A2 | | 1/1991 |
| FI | 83673 C | | 8/1991 |
| WO | 2018101827 A1 | | 6/2018 |

OTHER PUBLICATIONS

Machine translation of DE102005056472 (Year: 2007).*
Written Opinion for EP22176273.5.

* cited by examiner

*Primary Examiner* — Shawn Mckinnon
(74) *Attorney, Agent, or Firm* — Stiennon & Stiennon

(57) ABSTRACT

A monofilament yarn (10) has a polygon cross-section having a width and a height, which width is greater than the height, and four corners (11, 12, 13, 14) of which the first two opposite corners (11, 13) have angles of over 90 degrees, and the second two opposite corners (12, 14) have angles under 90 degrees, said width being 0.1 to 3 mm. The rounded first two opposite corners have a radius of 0.1 to 0.15 mm, and the rounded second two opposite corners have a radius of 0.075 to 0.1 mm. The yarn may be used to fabricate an industrial textile, which may be a papermaking fabric such as a dryer fabric or a forming fabric, or a filter fabric, such as a disc filter, a horizontal vacuum belt filter, a belt filter press, a twin wire press, a drum filter, a pan filter, a gravity table or a filter press.

22 Claims, 2 Drawing Sheets

MONOFILAMENT YARN

CROSS REFERENCES TO RELATED APPLICATIONS

This application claims priority on Finnish App. No. FI 20215654, filed Jun. 4, 2021, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to monofilament yarns, particularly to monofilament yarns used in industrial textiles.

Yarns having circular or flat rectangle shaped cross-sections normal to their longitudinal axes are commonly used for weaving industrial textiles. Circular wefts have high strength against high power shower used for cleaning the industrial textiles, but they have a poor warp coverage. Flat wefts instead provide a good warp coverage and a smooth surface for the textile, which causes less marking. However, they have tendency to crack and fibrillate.

High power shower can have power of for example, 500 to 600 bars. High power shower is guided through nozzles having a diameter of 0.2 to 0.5 mm, for example. When the industrial textile is cleaned by this thin powerful shower, the flat rectangle shaped yarns have a tendency to crack due to poor high power shower resistance. In addition, water has a tendency to splash randomly from the flat surfaces of the yarns.

In use, industrial textiles are usually configured as endless belts. Opposing ends of the industrial textile are seamed together to form a continuous loop during installation of the fabric on the equipment. One conventional method of seaming is to form the machine direction yarns on each end of the fabric into a series of loops. The loops of the respective fabric ends are then intermeshed during fabric installation to define a loop channel through which a pintle is inserted to lock the ends together. However, corners of the flat rectangle shaped yarns resist a seaming yarn to go through the loop channel. Further, the flat yarns have a tendency to split under tension and during the use of the textile.

U.S. Pat. No. 6,037,047 discloses a yarn comprising a plurality of filaments. Each of the filaments comprises a synthetic melt spun polymer having a relative viscosity about 24 to about 42, a denier of about 4 to about 8, a tenacity of about 6.5 grams/denier to about 9.2 grams/denier. Each of the filaments has an elongated diamond shaped cross section normal to a longitudinal axis of the filament. However, the yarn has a complex cross-sectional shape. Furthermore, the plurality of small filaments having acute corners form an uneven surface into the yarn. When the yarns are weaved into a paper machine fabric, the acute corners can even cause breakage of a produced web. In addition, the yarn may not hold its shape under the load and may not withstand the high power shower.

Therefore, there is need for improving the above-mentioned properties.

SUMMARY OF THE INVENTION

The object of at least some embodiments of the present invention is to provide a yarn having a cross-sectional shape which has improved high power cleaning resistance against shower impact, and improved bending behavior. The object of at least some embodiments of the present invention is to provide a yarn having easy seaming properties.

According to a first aspect of the present invention, there is provided a monofilament yarn, which has a polygon cross-section having a width and a height, which width is greater than the height, and four corners of which the first two opposite corners have angles of over 90 degrees, and the second two opposite corners have angles under 90 degrees, said width being 0.1 to 3 mm.

According to an embodiment of the present invention, the first two opposite corners and/or the second two opposite corners are rounded.

According to an embodiment of the present invention, a ratio of the height to the width is 2:2.1 to 2:6, preferably 2:2.5 to 2:4.

According to an embodiment of the present invention, the angles of the first two opposite corners are 90 to 180 degrees, preferably 90 to 170 degrees.

According to an embodiment of the present invention, the angles of the second two opposite corners are 10 to 80 degrees, preferably 20 to 50 degrees.

According to a second aspect of the present invention, there is provided an industrial textile comprising a plurality of warps in a first direction, and a plurality of wefts in a second direction, which is substantially perpendicular to the first direction, wherein at least some of the warps and/or at least some of the wefts comprise the polygon shaped monofilament yarns.

According to an embodiment of the present invention, an industrial textile has two opposite surfaces, wherein the two sides adjacent to one of the first two opposite corners of a monofilament yarn form at least a part of one of the surfaces.

According to an embodiment of the present invention, the industrial textile is a papermaking fabric, such as a dryer fabric or a forming fabric, or a filter fabric, such as a disc filter, a horizontal vacuum belt filter, a belt filter press, a twin wire press, a drum filter, a pan filter, a gravity table or a filter press.

DESCRIPTION OF THE PREFERRED EMBODIMENTS

In the present context, the term "polygon" refers to a shape having a plurality of corners, preferably three to seven corners, more preferably three to six corners, most preferably four corners.

In the present context, the term "industrial textile" refers to a woven structure comprising a plurality of warps in a first direction and a plurality of wefts in a second direction. The second direction is substantially perpendicular to the first direction. The first direction can be a machine direction and the second direction can be a cross-machine direction. Seam ends of the industrial textile can be connected to each other for forming a seam when installed on an equipment. The industrial textile can be configured to run in the machine direction.

In the present context, the term "machine direction" refers to a moving direction of the textile in the paper, board or tissue machine when the textile is assembled to the paper, board or tissue machine.

In the present context, the teen "cross machine direction" refers to a direction, which is perpendicular to the moving direction of the textile in the paper, board or tissue machine when the textile is assembled to the paper, board or tissue machine.

In the present context, the term "first surface" refers to a surface of the industrial textile, which is in contact with paper, board or tissue produced, when the textile is assembled in a paper, board or tissue machine, or through which fluid is filtered, when the textile is assembled on a filtering equipment.

In the present context, the term "second surface" refers to a surface of the industrial textile, which is in contact with a paper, board or tissue machine equipment or a filtering equipment, when the textile is assembled to the paper, board or tissue machine or the filtering equipment.

Figure 1:
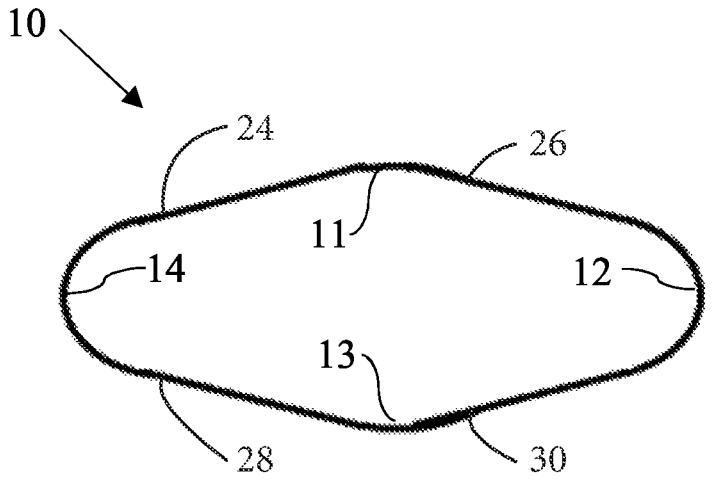
FIG. 1 illustrates a monofilament yarn in accordance with at least some embodiments of the present invention.

FIG. 1 illustrates a monofilament yarn 10 according to some embodiments. The yarn has a polygon, such as an elongated diamond shaped, cross-section. The cross-section has a width and a height, which width is greater than the height, and four corners 11, 12, 13, 14. First two opposite corners 11, 13 have angles of over 90 degrees. Second two opposite corners 12, 14 have angles under 90 degrees. The said width is 0.1 to 3 mm. The monofilament yarn 10 has a first side 24, a second side 26, a third side 28 and a fourth side 30. The corner 11 is defined between the first side 24 and the second side 26, the corner 12 is defined between the second side 26 and the fourth side 30, the corner 13 is defined between the fourth side 30 and the third side 28, and the corner 14 is defined between the third side 28 and the first side 24.

According to some embodiments, the width is 0.3 to 2 mm, preferably 0.6 to 1.2 mm.

The polygon shaped cross-section of the yarn provides improved bending behavior and cracking resistance. When the yarn is woven into an industrial textile, the yarn has improved cleaning resistance against a high power washing liquid flow or flushing flow due to the polygon shaped cross-section. Further, the shape provides better cleaning results, because the corners having angles of over 90 degrees guide the flow along the slanted sides of the yarn towards an inner structure of the textile, and the flow is not splashed randomly away from the surface. The flow is more effectively utilized for removing accumulated dirt and fibers from the textile structure. Thus, properties of the industrial textile can be recovered, and the operational life of the textile can be longer than in known solutions. Since the washing energy is directed effectively through the textile, lower pressures may be used in the washing liquid flows and the flushing flows. Further, the washing liquid flows and the flushing flows having lower pressures do not damage structures of the yarns of the textile. In addition, the textile is easy to seam.

According to some embodiments, the first two opposite corners 11, 13 and/or the second two opposite corners 12, 14 are rounded. When the corners 11, 12, 13, 14 are rounded, there are no sharp corners, which can cause, for example, marking of the produced web. Further, the shape of the yarn allows a seaming yarn to go smoothly in a loop channel, because there is no sharp yarn corners resisting.

The rounded first two opposite corners 11, 13 of the mono filament yarn 10 can have a radius of 0.05 to 0.25 mm, preferably 0.1 to 0.25 mm, more preferably 0.1 to 0.15 mm.

The rounded second two opposite corners 12, 14 of the monofilament yarn 10 can have smaller radiuses than the first two opposite corners 11, 13. The radius can be 0.05 to 0.15 mm, preferably 0.075 to 0.1 mm, more preferably 0.1 mm.

According to some embodiments the height of the cross-section of the monofilament yarn 10 is 0.05 to 1.0 mm. This enables producing of a thin textile.

According to some embodiments, a ratio of the height to the width of the monofilament yarn 10 is 2:2.1 to 2:6, preferably to 2:2.5 to 2:4. This enables good warp coverage and producing of a thin textile.

The first two opposite corners 11, 13 of the monofilament yarn 10 can have equal angles and/or the second two opposite corners 12, 14 can have equal angles. Then, the angle of the corner 11 can be the same as the angle of the opposite corner 13 and/or the angle of the corner 12 can be the same as the angle of the opposite corner 14. Thus, the cross-section of the monofilament yarn 10 can be symmetric.

Alternatively, the first two opposite corners 11, 13 have different angles and/or the second two opposite corners 12, 14 have different angles. Then, the angle of the corner 11 can be greater/smaller than the angle of the opposite corner 13 and/or the angle of the corner 12 can be greater/smaller than the angle of the opposite corner 14. Thus, the cross-section of the monofilament yarn 10 can be asymmetric. When the monofilament yarn 10 is a weft, the asymmetric cross-section enables producing variety different surface shapes to the industrial textile 20, which enables producing of different surface properties and seam properties.

The angles of the first two opposite corners 11, 13 of the monofilament yarn 10 can be 90 to 180 degrees, preferably 90 to 170 degrees.

The angles of the second two opposite corners 12, 14 of the monofilament yarn 10 can be 10 to 80 degrees, preferably 20 to 50 degrees.

Figure 2:
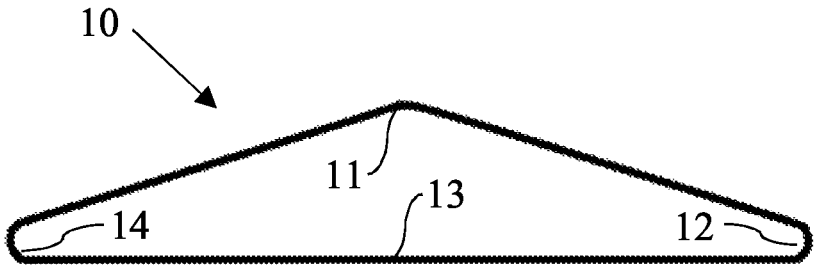
FIG. 2 illustrates a monofilament yarn in accordance with at least some embodiments of the present invention.

FIG. 2 illustrates a monofilament yarn 10 according to some embodiments. One corner 13 of the first two opposite corners 11, 13 has an angle of 180 degrees. Then, a side opposite to the other corner 11 of the first two opposite corners 11, 13 is flat.

The monofilament yarn 10 can be solid. Solid is understood to be massive and non-porous. So, there are no voids or cavities in the yarn.

According to some embodiments, the monofilament yarn 10 consists essentially of a virgin or recycled thermoplastic polymer, such as polyethylene terephthalate (PET), polyphenylene sulfide (PPS), polyketone (PK), polyether ether ketone (PEEK), polyamide (PA), polypropylene (PP), polyvinylidene difluoride (PVDF), or biopolymer. The PPS yarn possess excellent heat and chemical resistance, high dimensional stability, low moisture absorption and high resistance to hydrolysis. The PET yarn possesses restricted properties compared to the PPS yarn in many respects, but the properties give extra elasticity for example, to the dryer fabric.

The yarn 10 comprising polyketone (PK) can comprise another polymer as a blend, or there may be a core or a sheath structure. There can be a polyketone sheath and a core of another polymer.

According to some embodiments, the monofilament yarn 10 can consist essentially of a virgin or recycled thermoplastic aliphatic polyketone (PK) as a first polymer, and virgin or recycled polyolefin (PO), polyester (PES), polyphenylene sulfone (PPSU), polyurethane (PU), polyphenylene sulfide (PPS), polyphenylene ether (PPE), polyphenylene ketone, polyphenylene etherketone (PEEK), liquid crystalline polymer and/or aliphatic polyketone as a second polymer.

The thermoplastic polymer may comprise additives, such as pigments, light stabilizers, heat and oxidation stabilizers, additives for reducing static, and additives for modifying dye.

The thermoplastic polymer, such as PET, can comprise a chemical hydrolysis stabilizer for preventing degradation. The chemical hydrolysis stabilizer can be a carbodiimide compound, such as a cyclic carbodiimide compound, an aromatic polycarbodiimide, or a monomeric carbodiimide.

The thermoplastic polymer can be melt spun into the monofilament yarn.

The monofilament yarn 10 can be an industrial monofilament yarn, particularly used for an industrial textile 20.

According to some embodiments, an industrial textile 20 comprises a plurality of warps 31, 32 in a first direction and a plurality of wefts 33 in a second direction, which is substantially perpendicular to the first direction. At least some of the warps 31, 32 or at least some of the wefts 33 comprise the above-described monofilament yarns 10.

Thus, at least some of the warps 31, 32 or at least some of the wefts 33 can be the monofilament yarns 10. Then, the warps 31, 32 or the wefts 33 can comprise only the monofilament yarns 10, or at least some of the warps 31, 32 or at least some of the wefts 33 comprise the monofilament yarns 10. The warps 31, 32 and the wefts 33 can be made of the same or different materials.

Alternatively, at least some of the warps 31, 32 and at least some of the wefts 33 can comprise the monofilament yarns 10. Then, the industrial textile 20 can comprise only the monofilament yarns 10, or at least some of the warps 31, 32 and at least some of the wefts 33 comprise the monofilament yarns 10. The wefts 33 and the warps 31, 32 can be made of the same or different materials.

When at least some of the warps 31, 32 comprise the monofilament yarn 10, cross-sections of the wefts 33 can be round, square, rectangular, oval or any other suitable shape. The wefts 33 can be a monofilament yarn. The warps 31, 32 and the wefts 33 can be made of the same or different materials.

Respectively, when at least some of the wefts 33 comprise the monofilament yarn 10, cross-sections of the warps 31, 32 can be round, square, rectangular, oval or any other suitable shape. The warps 31, 32 can be a monofilament yarn. The wefts 33 and the warps 31, 32 can be made of the same or different materials.

According to some embodiments, at least some of the warps 31, 32 and at least some of the wefts 33 of the industrial textile 20 comprise the mono filament yarn 10. Then, all of the warps 31, 32 and all of the wefts 33 can comprise the monofilament yarn 10.

Figure 3:
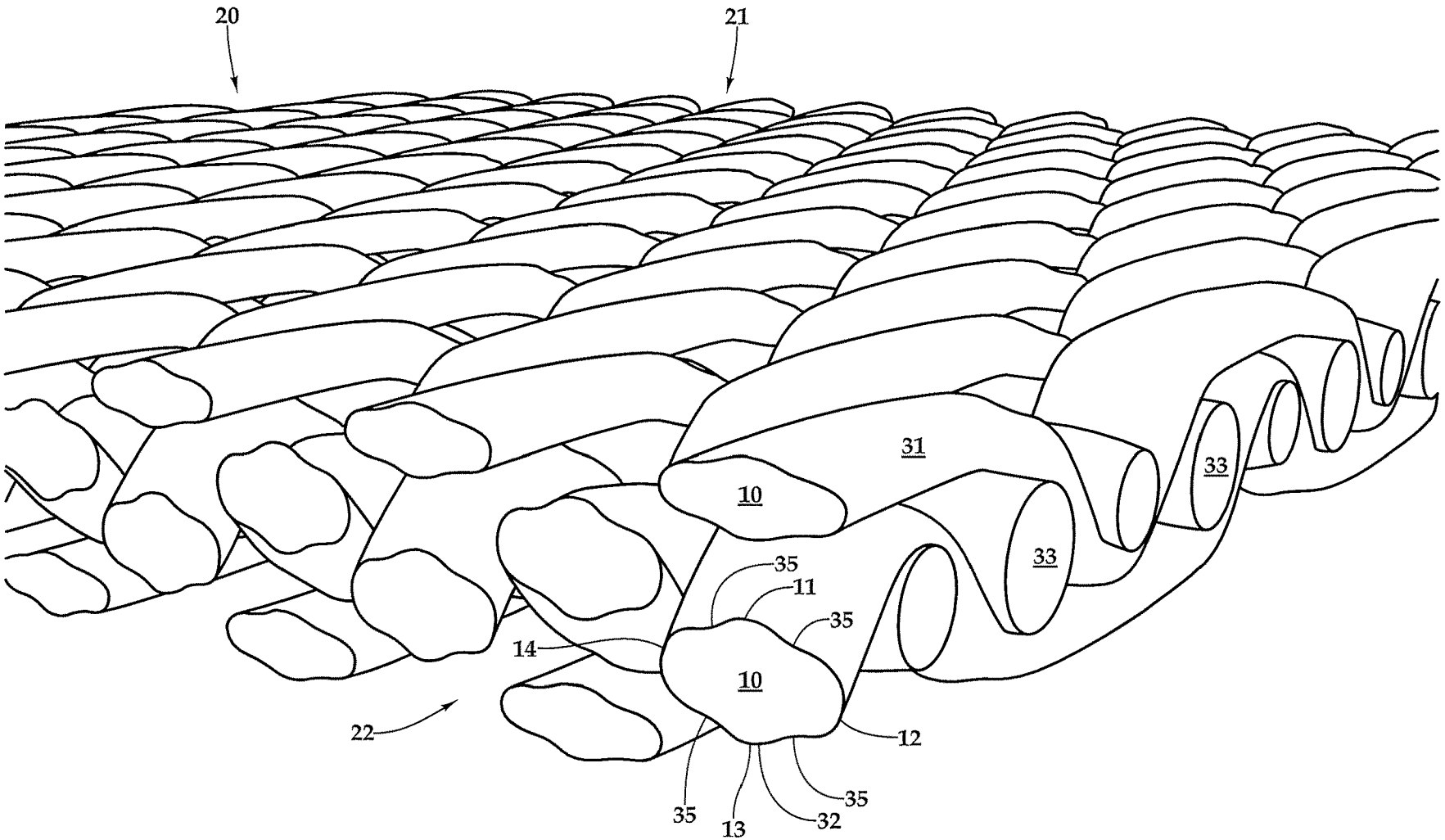
FIG. 3 illustrates an industrial textile having the monofilament yarn as a warp in accordance with at least some embodiments of the present invention.

FIG. 3 illustrates an industrial textile 20 according to some embodiments. The industrial textile 20 comprises a plurality of the mono filament yarns 10 having the polygon shaped cross-section as warps 31, 32 and a plurality of round yarns as wefts 33. The warps 31, 32 extend in a first direction and the wefts 33 extend in a second direction, which is substantially perpendicular to the first direction. The textile comprises a double warp. The double warp comprises a first warp 31 and a second warp 32 in the first direction. The yarns of the first warp 31 are arranged above the yarns of the second warp 32.

FIG. 3 illustrates that the industrial textile 20 has two opposite surfaces: a first surface 21 and a second surface 22. The monofilament yarns have two first opposite corners 11, 13 and two second opposite corners 12, 14. Between each first opposite corner and second opposite corner there is a concave arc 35. The two sides adjacent to one of the first two opposite corners 11, 13 of a monofilament yarn 10 form at least a part of one of the surfaces 21, 22. Thus, the first two opposite corners 11, 13 of the mono filament yarns 10 form substantially the first surface 21 and the second surface 22 of the industrial textile 20. This provides a smooth surface on the first surface of the industrial textile for preventing generation of markings to a fiber web. Furthermore, this provides improved cleaning resistance against a high-power washing liquid flow or flushing flow. The shape of the monofilament yarn directs a shower flow into the fabric structure and enables better cleaning result.

FIG. 3 further illustrates that the monofilament yarns 10 are at the same angle relatively to the first surface 21 of the industrial textile 20. This enables a smooth first surface of the industrial textile 20.

However, the mono filament yarns 10 of the industrial textile 20 can be set to different angles relatively to the first surface 21 of the industrial textile 20. This enables modifying properties of the first surface, such as filtering properties.

The industrial textile 20 can be a papermaking fabric, such as a dryer fabric or a forming fabric, or a filter fabric, such as a disc filter, a horizontal vacuum belt filter, a belt filter press, a twin wire press, a drum filter, a pan filter, a gravity table or a filter press.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and examples of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", i.e., a singular form, throughout this document does not exclude a plurality.

We claim:

1. A monofilament yarn for an industrial textile, which has a yarn cross-section having:

a width and a height, which width is greater than the height, and the yarn cross-section has four corners comprised of two first opposite corners and two second opposite corners, wherein the angle of each first opposite corner is over 90 degrees, and the angle of each second opposite corner is under 90 degrees, wherein between each first opposite corner and second opposite corner there is a concave arc;

wherein the width is from 0.1 to 3 mm;

wherein the two first opposite corners and the two second opposite corners are rounded; and wherein the rounded two first opposite corners have a radius of 0.1 to 0.15 mm, and the rounded two second opposite corners have a radius of 0.075 to 0.1 mm.

2. The monofilament yarn of claim 1, wherein the width is 0.3 to 2 mm.

3. The monofilament yarn of claim 2, wherein the width is 0.6 to 1.2 mm.

4. The monofilament yarn of claim 1, wherein the height is 0.05 to 1.0 mm.

5. The monofilament yarn of claim 1, wherein a ratio of the height to the width is 2:2.1 to 2:6.

6. The monofilament yarn of claim 5, wherein the ratio of the height to the width is 2:2.5 to 2:4.

7. The monofilament yarn of claim 1, wherein the angles of the two first opposite corners are equal angles and the angles of the two second opposite corners are equal.

8. The monofilament yarn of claim 1, wherein the angles of the two first opposite corners are different and the angles of the two second opposite corners are different.

9. The monofilament yarn of claim 1, wherein the angles of the two first opposite corners are not greater than 180 degrees.

10. The monofilament yarn of claim 9 wherein the angles of the two first opposite corners are not greater than 170 degrees.

11. The mono filament yarn of claim 1, wherein the angles of the two second opposite corners are 10 to 80 degrees.

12. The monofilament yarn of claim 11 wherein the angles of the two second opposite corners are 20 to 50 degrees.

13. The monofilament yarn of claim 1, wherein the yarn is solid.

14. The monofilament yarn of claim 1, where the yarn consists essentially of a virgin or recycled thermoplastic polymer selected from the group consisting of polyethylene terephthalate, polyphenylene sulfide, polyketone, polyether ether ketone, polyamide, polypropylene, polyvinylidene difluoride, and biopolymer.

15. The monofilament yarn of claim 1, wherein the yarn consists essentially of a virgin or recycled aliphatic polyketone as a first polymer, and virgin or recycled polyolefin, polyester, polyphenylene sulfone, polyurethane, polyphenylene sulfide, polyphenylene ether, polyphenylene ketone, polyphenylene etherketone, liquid crystalline polymer and/or aliphatic polyketone as a second polymer.

16. The monofilament yarn of claim 1 wherein the monofilament yarn forms a part of an industrial textile.

17. An industrial textile comprising:

a plurality of warps extending in a first direction;

a plurality of wefts extending in a second direction, which is substantially perpendicular to the first direction; and wherein at least some of the plurality of warps and/or at least some of the plurality of wefts comprise a monofilament yarn, which has a yarn cross-section having:

a width and a height, which width is greater than the height, and the yarn cross-section has four corners comprised of two first opposite corners and two second opposite corners, wherein the angle of each first opposite corner is over 90 degrees, and the angle of each second opposite corner is under 90 degrees, wherein between each first opposite corner and second opposite corner there is a concave arc;

wherein the width is from 0.1 to 3 mm;

wherein the two first opposite corners and the two second opposite corners are rounded; and wherein the rounded two first opposite corners have a radius of 0.1 to 0.15 mm, and the rounded two second opposite corners have a radius of 0.075 to 0.1 mm.

18. The industrial textile of claim 17, wherein at least some of the warps comprise the monofilament yarn and the wefts are comprised of a yarn having a round, square, rectangular or oval cross-section, or wherein at least some of the wefts comprise the monofilament yarn and the warps are comprised of a yarn having a round, square, rectangular or oval cross-section.

19. The industrial textile of claim 17, wherein at least some of the warps and at least some of the wefts comprise the monofilament yarn.

20. The industrial textile of claim 17, wherein the industrial textile has two opposite surfaces, and wherein the monofilament yarn has a first side and a second side, and wherein one of the first two opposite corners is defined between the first side and the second side, and wherein one of the first side and the second side forms at least a part of one of the two opposite surfaces of the industrial textile.

21. The industrial textile of claim 17, wherein the industrial textile is a papermaking fabric, a dryer fabric or a forming fabric, or a filter fabric, a disc filter, a horizontal vacuum belt filter, a belt filter press, a twin wire press, a drum filter, a pan filter, a gravity table or a filter press.

22. A monofilament yarn for an industrial textile, which has a yarn cross-section having:

a width and a height, which width is greater than the height, and the yarn cross-section has a first side, a second side, a third side, and a fourth side, and wherein a first corner is defined between the first side and the second side, the first side and the second side having a first interior angle defined therebetween;

wherein a second corner is defined between the second side and the fourth side, the second side and the fourth side having a second interior angle defined therebetween;

wherein a third corner is defined between the fourth side and the third side, the fourth side and the third side having a third interior angle defined therebetween; and wherein a fourth corner is defined between the third side and the first side, the third side and the first side having a fourth interior angle defined therebetween;

wherein the first corner and the third corner are opposite one another to define two first opposite corners, and the second corner and the fourth corner are opposite each other to define two second opposite corners, wherein the first interior angle and the third interior angle are greater than 90 degrees, and the second interior angle and the fourth interior angle are less than 90 degrees, wherein between each first opposite corner and second opposite corner there is a concave arc;

wherein the width is from 0.1 to 3 mm;

wherein the two first opposite corners and the two second opposite corners are rounded; and wherein the rounded two first opposite corners have a radius of 0.1 to 0.15 mm, and the rounded two second opposite corners have a radius of 0.075 to 0.1 mm.

* * * * *